US007366447B2

(12) United States Patent
Mukai et al.

(10) Patent No.: US 7,366,447 B2
(45) Date of Patent: Apr. 29, 2008

(54) IMAGE FORMING APPARATUS HAVING NON-CONTACT CHARGING ROLLER

(75) Inventors: Takashi Mukai, Yamatokoriyama (JP); Syohji Tomita, Yao (JP); Hiroshi Onda, Yamatokoriyama (JP); Atsuyuki Katoh, Tenri (JP); Hiroshi Ishii, Osaka (JP); Yoshinobu Okumura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 124 days.

(21) Appl. No.: 10/547,936

(22) PCT Filed: Mar. 10, 2004

(86) PCT No.: PCT/JP2004/003127

§ 371 (c)(1),
(2), (4) Date: Sep. 8, 2005

(87) PCT Pub. No.: WO2004/081672

PCT Pub. Date: Sep. 23, 2004

(65) Prior Publication Data

US 2006/0170935 A1 Aug. 3, 2006

(30) Foreign Application Priority Data

Mar. 11, 2003 (JP) ..... 2003-065707

(51) Int. Cl.
*G03G 15/02* (2006.01)

(52) U.S. Cl. ..... 399/168; 399/176

(58) Field of Classification Search ..... 399/148, 399/159, 168, 174, 176, 357, 111
See application file for complete search history.

(56) References Cited

U.S. PATENT DOCUMENTS 5,146,280 A * 9/1992 Kisu ..... 399/176
5,579,085 A * 11/1996 Miyabe et al. ..... 399/111
6,470,161 B2 * 10/2002 Fujishiro et al. ..... 399/159
6,546,219 B2 * 4/2003 Sato et al. ..... 399/176
6,628,912 B2 * 9/2003 Amemiya et al. ..... 399/174
6,721,523 B2 * 4/2004 Sugiura et al. ..... 399/176
6,778,797 B2 * 8/2004 Sato et al. ..... 399/176

FOREIGN PATENT DOCUMENTS

| | | | |
|---|---|---|---|
| JP | 5-307279 | A | 11/1993 |
| JP | 6-50416 | B2 | 6/1994 |
| JP | 7-301973 | A | 11/1995 |
| JP | 10-48904 | A | 2/1998 |
| JP | 2000-132000 | A | 5/2000 |
| JP | 2001-188403 | A | 7/2001 |
| JP | 2001-296723 | A | 10/2001 |
| JP | 2001-305796 | A | 11/2001 |
| JP | 2001-350321 | A | 12/2001 |
| JP | 2002-148904 | A | 5/2002 |
| JP | 2002-244489 | A | 8/2002 |

* cited by examiner

*Primary Examiner*—Sandra L. Brase
(74) *Attorney, Agent, or Firm*—Birch, Stewart, Kolasch & Birch, LLP

(57) ABSTRACT

Flanges are pressed into opposite ends of a photoreceptor drum. A noncontact charging roller is arranged so as to face, but have no direct contact with, the photoreceptor drum. On both end portions of the noncontact charging roller, spacers are provided for maintaing a gap between the photoreceptor drum and the noncontact charging roller. The spacers are of tape form and wound around the noncontact charging roller. Winding positions of the spacers are distant by more than an effective projection length of each of the flanges from respective opposite ends of the charging roller.

9 Claims, 19 Drawing Sheets

IMAGE FORMING APPARATUS HAVING NON-CONTACT CHARGING ROLLER

TECHNICAL FIELD

This invention relates to electrophotographic image forming apparatus using a noncontact charging method.

BACKGROUND ART

In conventional image forming apparatus such as electrophotographic copying machines, a surface of a photoreceptor (a charged member) is positively or negatively charged uniformly by a corona discharge device. In a subsequent exposure process, certain points of the surface are selectively discharged to form an electrostatic latent image. Then, a developer supplying device with a predetermined amount of developing bias applied supplies developer to the surface of the photoreceptor, so that the latent image is visualized, i.e., developed.

Some image forming apparatus using the corona discharge method are provided with a combined developing/cleaning device. Such image forming apparatus uses a toner scattering process, instead of a dedicated cleaning device. In the toner scattering process, an electrically conductive brush scatters residual toner particles remaining on the photoreceptor after a preceding transfer process. Also, such apparatus adopts a developing process using magnetic toner. See Japanese examined Patent Application No. H06-50416, p. 3, left column, lines 4 to 7.

The combined developing/cleaning device allows for downsizing of such apparatus. However, the corona discharge device provided in such apparatus is easily affected by environmental factors such as humidity or dust. Also, the corona discharge process involves ozone emissions which have an unpleasant odor and possible harmful effects on human health.

One solution to the foregoing problems is a contact charging method in which a surface of a charged member (photoreceptor drum) is charged by direct contact with a conductive member (charging roller) to which a direct-current voltage with an alternating-current voltage superposed is applied.

The contact charging method, however, causes problems as described below. In an image forming apparatus using the contact charging method, a conductive member (charging roller) becomes in direct contact with a surface of a charged member (photoreceptor drum). Accordingly, when there are relatively hard particles, such as toner carriers, on the surfaces of the charged member and the conductive member, the particles scratch the surfaces when the surfaces become in contact with each other. Also, foreign particles which adhere to a portion of the surface of the conductive material (charging roller) cause a corresponding portion of the surface of the charged member (photoreceptor drum) to be non-uniformly charged.

To solve the foregoing problems of the contact charging method as well as to achieve the greatest advantage thereof, i.e., no ozone emission, there has been proposed a noncontact charging method in which a charging member is positioned in proximity to (thus, out of contact with) a photoreceptor. See FIG. 1 of JP-H05-307279-A, or FIG. 1 of JP-H07-301973-A.

Application of the noncontact charging method to an image forming apparatus provided with a two-component developing device has also been proposed. See paragraph [0019], and FIG. 1, of JP-2001-188403-A. In the apparatus, a narrowest gap between a discharging surface of a charging member and a photoreceptor is rendered larger than diameter of a toner carrier particle. This prevents a toner carrier, or toner carried on the toner carrier, from getting stuck in the gap. Thus, the toner carrier is prevented from scratching or contaminating the surfaces of the photoreceptor and the charging member.

However, the apparatus as disclosed by JP-2001-188403-A does not have a combined developing/cleaning device such as disclosed by Japanese examined Patent Application No. H06-50416. Consequently, the apparatus tends to grow in size and to require a high supply voltage. Also, since the narrowest gap between the surfaces of the charging member and the photoreceptor is rendered larger than the diameter of the toner carrier particle, an extra amount of voltage is required for charging the photoreceptor.

Further, if the gap is rendered smaller than the diameter of the toner carrier particle to solve the problem, a voltage applied to the charging roller is reduced. However, fluctuations in gap width may have greater effects, and therefore the gap width has to be maintained with high precision. Furthermore, a cleaning process is required to be performed on an upstream side of the photoreceptor and the charging roller in order to prevent the photoreceptor or the charging roller from being scratched or contaminated. The cleaning process potentially causes an increase in load torque, or abrasion of, and scratches on, the surface of the photoreceptor.

A feature of the invention is to offer an image forming apparatus using the noncontact charging method, capable of precisely adjusting a gap between a non-contact charging roller and a photoreceptor, so that the photoreceptor is prevented from being nonuniformly charged because of abnormal discharge or insufficient charging and therefore high quality image is ensured.

DISCLOSURE OF THE INVENTION

An image forming apparatus according to the invention includes a photoreceptor drum that has flanges pressed into opposite ends thereof, a noncontact charging roller that is arranged so as to face the photoreceptor drum but to have no direct contact with the photoreceptor drum, and spacers for maintaining a gap between the photoreceptor drum and the noncontact charging roller. The spacers are wound around opposite end portions of the noncontact charging roller. Winding positions of the spacers are distant by more than an effective projection length of each of the flanges from the respective opposite ends of the charging roller.

An outside diameter of a photoreceptor body increases across portions of the photoreceptor body into which the flanges are pressed, i.e., across pressed-in portions. In the foregoing configuration, therefore, the spacers wound around the noncontact charging roller are pressed against the photoreceptor drum at respective positions that are distant by more than an effective projection length of each of the flanges from the respective opposite ends of the charging roller. The foregoing configuration allows precise adjustment of the gap between the charging roller and the photoreceptor drum, thereby preventing the photoreceptor drum from being nonuniformly charged because of abnormal discharge or insufficient charging. High-quality image is thus ensured.

The flanges each have an efficient projection length of approximately 5 mm as measured from the respective opposite ends of the photoreceptor drum. As shown in FIG. 3, the outside diameter of the photoreceptor drum shows a slight increase at a distance from the opposite ends of more than approximately 10 mm, i.e., more than twice the efficient projection length.

Accordingly, the gap is precisely adjusted by setting the winding positions of the spacers distant by twice the effective projection length to approximately 10 mm from the respective opposite ends of the charging roller. In order to avoid limitations on a transfer area ?c and an image area ic as shown in FIG. 4(B), it is preferable not to set the respective winding positions of the spacers even more distant from the opposite ends of the charging roller.

The flanges each having an outside diameter smaller than an inside diameter of the photoreceptor drum can be fixedly bonded to the respective opposite ends of the photoreceptor drum with an adhesive that has a linear expansion coefficient approximately equal to a linear expansion coefficient of the photoreceptor drum.

In the foregoing configuration, a ultraviolet-curable resin, hereinafter UV-curable resin, having a linear expansion coefficient of $3.0*10^{-5}$ is usable as such adhesive. Since an aluminum base shaft of the photoreceptor body has a linear expansion coefficient of $2.3*10^{-5}$, there is a slight difference in linear expansion coefficient and therefore little difference in thermal expansion between the UV-curable resin and the base shaft. Accordingly, little negative effects such as buckling are caused. Furthermore, the UV-curable resin allows the bonding operation to be performed with high precision and operability.

Also, negative effect such as buckling is unlikely to be caused when the flanges, the photoreceptor body, and the adhesive to be used for bonding the flanges to the photoreceptor body have approximately equal linear expansion coefficients.

Approximately equal linear expansion coefficients of the flanges and the photoreceptor body also allow the bonding operation to be performed with high precision. For example, a combination of the aluminum base shaft of the photoreceptor body that has the linear expansion coefficient of 2.3*10−5 and flanges each including an ABS resin that has a linear expansion coefficient of 3.0*10−5 (e.g., Asahi Kasei Corporation Product No. R420) results in an increase of 3.2 μm in the outside diameter of the photoreceptor body at a temperature rise of 30° C. The increase has little negative effects.

Since conventional plastic resins have linear expansion coefficients of approximately $10*10^{-5}$, it is preferable to selectively use a resin material having a small linear expansion coefficient.

The spacers may be each wound with a single turn around the noncontact charging roller, with opposite ends of each spacer cut at an angle and arranged so as to face each other across a gap of predetermined width. Alternatively, the spacers may be each wound with a plurality of turns around the noncontact charging roller. Also, the spacers may be each wound with a single turn around the noncontact charging roller, with opposite ends of each spacer cut at an angle and one end overlapped by the other end on the charging roller. Furthermore, the spacers may each have two parts that are shorter than the circumference of the noncontact charging roller, and the two parts may be wound adjacently around the charging roller.

BEST MODE FOR CARRYING OUT THE INVENTION

Figure 1:
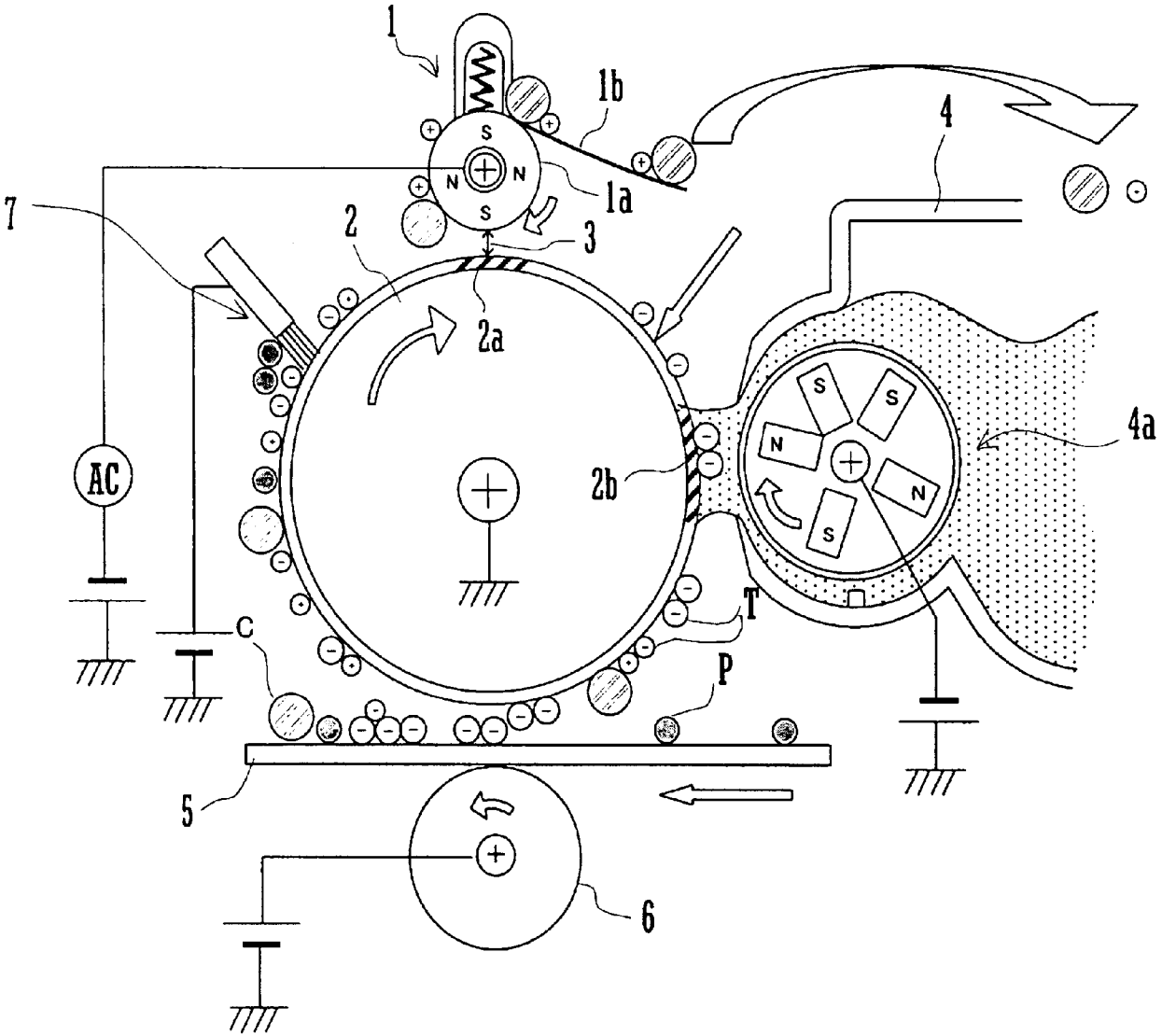
FIG. 1 is a view illustrating configuration of a relevant part of an image forming apparatus according to embodiments of the invention.
Figure 2:
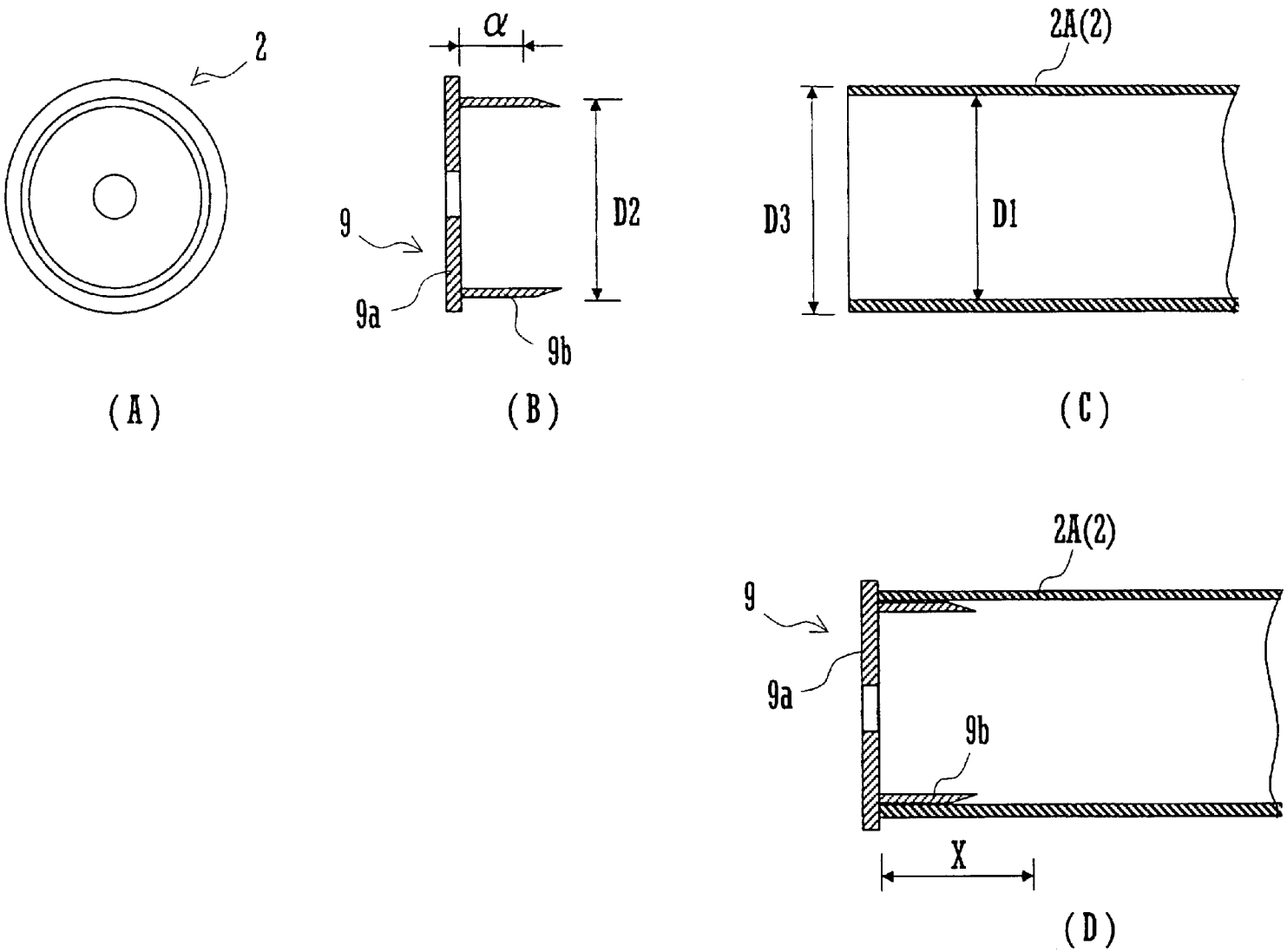
FIGS. 2(A) through 2(D) are views illustrating a manner in which a photoreceptor drum and each of flanges of the image forming apparatus are fitted together.

FIG. 1 is a view illustrating a configuration of a relevant part of an image forming apparatus according to embodiments of the invention as described below.

The image forming apparatus includes a noncontact charging device 1, a charging roller 1*a*, a cleaning mylar sheet 1*b*, a photoreceptor drum 2, a two-component developing device 4, a developing roller 4*a*, a transferring roller 6, and a charge-regulating/scattering brush 7. The charging roller 1*a* corresponds to the noncontact charging roller of the invention. The charging roller 1*a* is magnetized, and is biased downwards by a spring. The photoreceptor drum 2 is driven to rotate clockwise in FIG. 1. The developing roller 4*a* is magnetized and is driven to rotate clockwise in FIG. 1. A recording medium 5 as shown in the figure is transported at a predetermined transport speed (e.g., a process speed of 130 mm/s). There is a gap 3 of 40 μm between circumferential surfaces of the charging roller 1*a* and the photoreceptor drum 2.

The noncontact charging device 1 has two functions of charging the photoreceptor drum 2 and of cleaning the circumferential surface of the photoreceptor drum 2. To the noncontact charging device 1, a charging bias (i.e., a direct-current voltage with an alternating-current voltage superposed; −600 Vdc+1.8 KVpp/900 Hz) is applied. The device 1 is rotated in an against direction, i.e., a clockwise direction in the figures, with a circumference speed ratio of the device 1 to the photoreceptor drum 2 being 0.5:1. While being rotated, the noncontact charging device 1 charges a portion 2*a* of the circumferential surface of the photoreceptor drum 2.

A developing roller 4*a* is positioned so that there is a gap of approximately 2 mm between the roller 4*a* and the photoreceptor drum 2. To the developing roller 4*a*, a developing bias is applied. The roller 4*a* is rotated in the against direction, with a circumference speed ratio of the roller 4*a* to the photoreceptor drum 2 being 2.25:1. While being rotated, the roller 4*a* feeds toner particles T, which are carried by carriers C, onto the photoreceptor drum 2, so that an electrostatic latent image formed on the circumferential surface of the photoreceptor drum 2 by a not-shown exposure device is developed into a toner image on a portion 2*b*.

A transfer bias of +2 kV is applied to a transferring roller 6. The roller 6 is rotated in a "with" direction (i.e., in a counterclockwise direction in the figure) at a process speed. While being rotated, the roller 6 presses the recording medium 5 against the photoreceptor drum 2 and transports the medium 5, so that the toner image formed on the photoreceptor drum 2 is transferred to the medium 5. On the surface of the photoreceptor drum 2 after the toner image is transferred, there are residues such as untransferred toner particles T or carriers C, as well as paper dust P from a surface of the recording medium 5.

With a brush bias of +500 Vdc applied, the charge-regulating/scattering brush 7 adjusts charge quantity on the circumferential surface of the photoreceptor drum 2. The brush 7 scatters an electrostatic latent image remaining on the circumferential surface of the photoreceptor drum 2. The brush 7 also renders the residual toner particles T, carriers C, and paper dust P less attracted to the circumferential surface of the photoreceptor drum 2.

Then, the toner particles T remaining on the surface of the photoreceptor drum 2 are collected onto the cleaning mylar sheet 1*b* by an electric field of the charging roller 1*a*. The carries C are collected onto the mylar sheet 1*b* by a magnetic field of the charging roller l*a*. The toner particles T and carriers C as collected are returned into a toner bin of the developing device 4. Therefore, the image forming apparatus is not provided with an additional, separate cleaning device. Note that the toner particles T each have a diameter of 8 μm while the carriers C each have a diameter of 60 μm. Thus, the carriers C, which cannot pass through the gap 3 and are blocked by the charging roller 1*a*, are collected together with the toner particles T carried thereon.

To ensure that the charging and cleaning functions are properly performed, the image forming apparatus according to the embodiments has the following construction. Spacers 8 as shown in FIGS. 4 through 8 are wound around the charging roller 1*a* at respective winding positions near opposite ends of the roller 1*a*. The gap 3 between the charging roller 1 and the photoreceptor drum 2 is precisely adjusted by pressing the spacers 8 against the photoreceptor drum 2.

In a first embodiment as shown in FIGS. 2(A) through 2(D), flanges 9 are fitted with the photoreceptor body 2A by being pressed into opposite ends of the body 2A.

Each of the flanges 9 includes a circular plate 9*a* integrated with an insertion portion 9*b*. The insertion portion 9*b* has an effective projection length α of approximately 5 mm. The respective winding positions of the spacers 8 are more than the length α distant from the respective ends of the roller 1*a*. An outside diameter D2 of each of the flanges 9 is slightly larger than an inside diameter D1 of the photoreceptor body 2A. Thus, an outside diameter D3 of the photoreceptor body 2A increases across portions of the photoreceptor body 2A into which the flanges 9 are pressed, i.e., across pressed-in portions.

Figure 3:
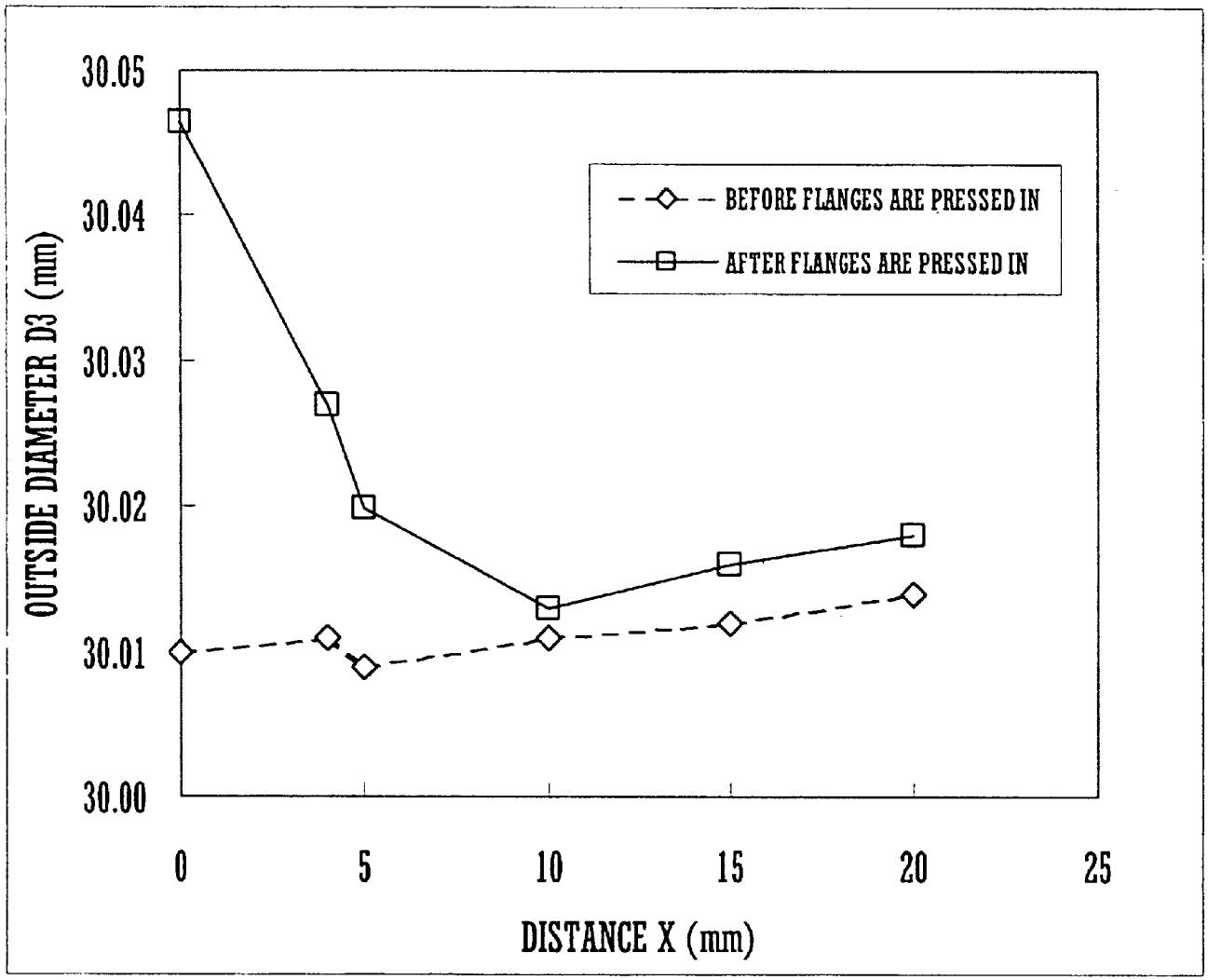
FIG. 3 is a graph indicating a change in outside diameter of the photoreceptor drum observed between before and after the flanges are pressed into the photoreceptor drum.
Figure 4:
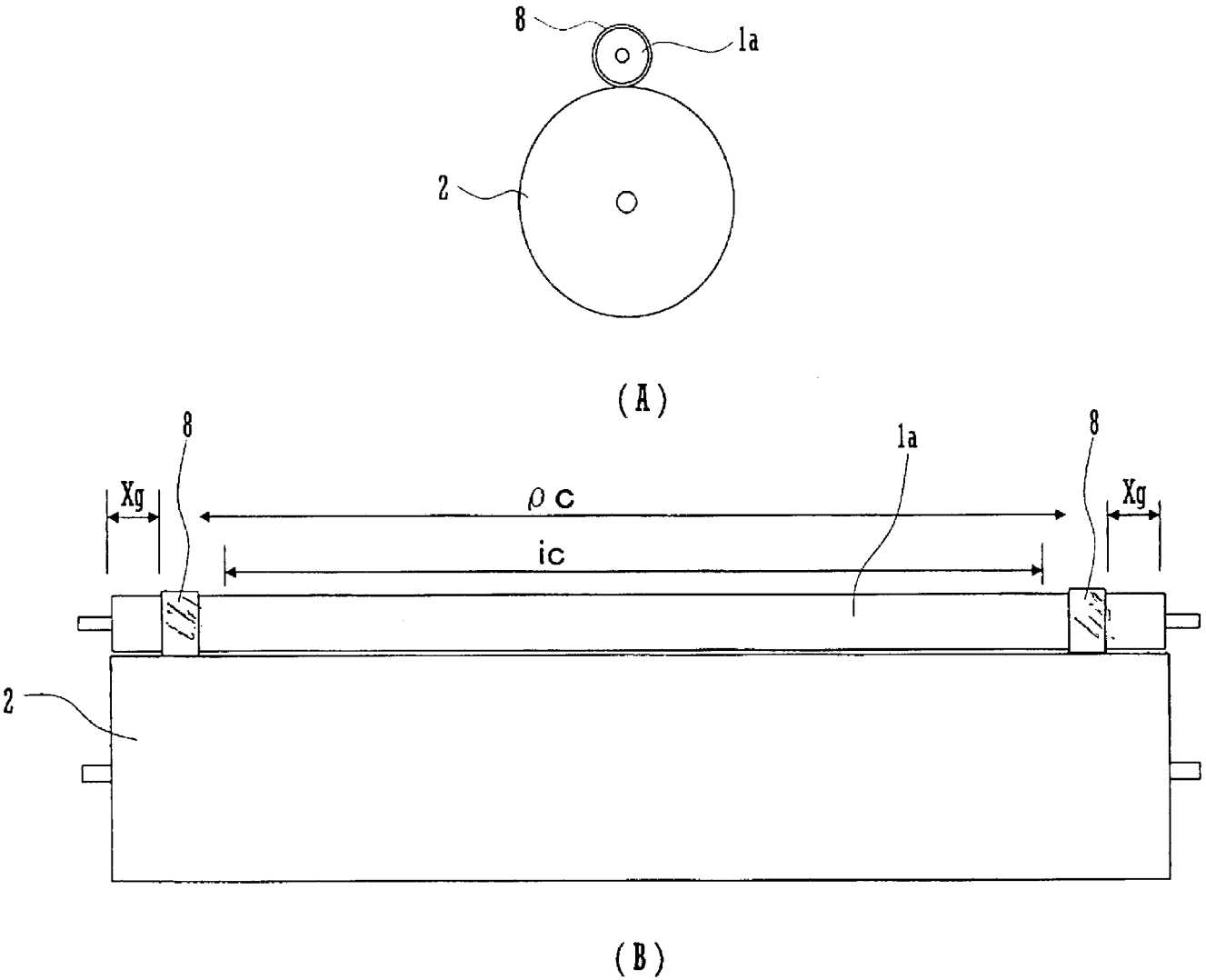
FIGS. 4(A) and 4(B) are diagrams illustrating an arrangement of a noncontact transfer roller and the photoreceptor drum of the image forming apparatus.

As is clear from FIG. 3, the outside diameter D3 shows a maximum increase at each of the opposite ends of the photoreceptor drum 2. The diameter D3 shows a marked increase, with distance X from each of the opposite ends ranging within 0 to 10 mm. With the distance X exceeding 10 mm, the diameter D3 shows a comparatively slight increase. More specifically, increase in the diameter D3 is negligibly small with the distance X exceeding twice the effective projection length a.

Accordingly, in order to avoid effects of the increase in outside diameter D3 in the pressed-in portions, the respective winding positions of the spacers 8 are set, for example as illustrated in FIG. 4(B), twice the effective projection length a distant, i.e., length Xg distant, from the opposite ends of the photoreceptor drum 2. The configuration as described above allows precise adjustment of the gap 3 between the charging roller 1*a* and the photoreceptor drum 2, thereby preventing the photoreceptor drum 2 from being nonuniformly charged because of abnormal discharge or insufficient charging. High-quality image is thus ensured.

Since the effective projection length α of each of the flanges 9 is possibly set at 5 mm or shorter, it is preferable that the respective winding positions of the spacers 8 are set twice the effective projection length distant, or approximately 10 mm distant, from the opposite ends of the photoreceptor body 2A. In order to avoid limitations on a transfer area ρc and an image area ic as shown in FIG. 4(B), it is preferable not to set the respective winding positions of the spacers 8 more distant from the opposite ends of the body 2A.

In another not-illustrated embodiment, alternatively, the flanges 9 may be fitted with the photoreceptor body 2A by bonding fittings of the flanges 9 and the body 2A. In the case, it is preferable that each of the flanges 9 has an outside diameter smaller than the inside diameter of the body 2A and that an adhesive to be used has a linear expansion coefficient approximately equal to that of the body 2A.

For example, a ultraviolet-curable resin, hereinafter UV-curable resin, having a linear expansion coefficient of $3.0*10^{-5}$ is usable as such adhesive. The photoreceptor body 2A includes an aluminum base shaft having a linear expansion coefficient of $2.3*10^{-5}$. Because of a slight difference in linear expansion coefficient between each other, the UV-curable resin and the base shaft has little difference in thermal expansion therebetween, thereby causing little negative effects such as buckling. Also, the UV-curable resin allows the bonding operation to be performed with high precision and operability.

In fitting the flanges 9 with the photoreceptor body 2A by bonding, when the flanges 9, the body 2A, and the adhesive have approximately equal linear expansion coefficients, little negative effect such as buckling is caused. More specifically, a combination is used of: the UV-curable resin as the adhesive; the photoreceptor body 2A including the aluminum base shaft which has a linear expansion coefficient of $2.3*10^{-5}$; and the flanges 9 including an ABS resin which has a linear expansion coefficient of $3.0*10^{-5}$ (e.g., Asahi Kasei Corporation Product No. R420). The combination results in an increase of 3.2 am in the outside diameter D3 at a temperature rise of 30° C. Accordingly, the combination prevents the outside diameter D3 from being increased to such a level as to have negative effects. Since conventional plastic resins have linear expansion coefficients of approximately $10*10^{-5}$, it is preferable to selectively use a resin material having a small linear expansion coefficient.

On the other hand, when the charging roller 1*a* is rotated in the clockwise direction as shown in FIG. 1, the spacers 8 are subject to friction against the photoreceptor drum 2 and have a high tendency to become unwound. In order to maintain the gap 3 precisely, therefore, it is required that the spacers 8 be tightly wound around the charging roller 1*a* so as not to become unwound under friction.

Figure 5:
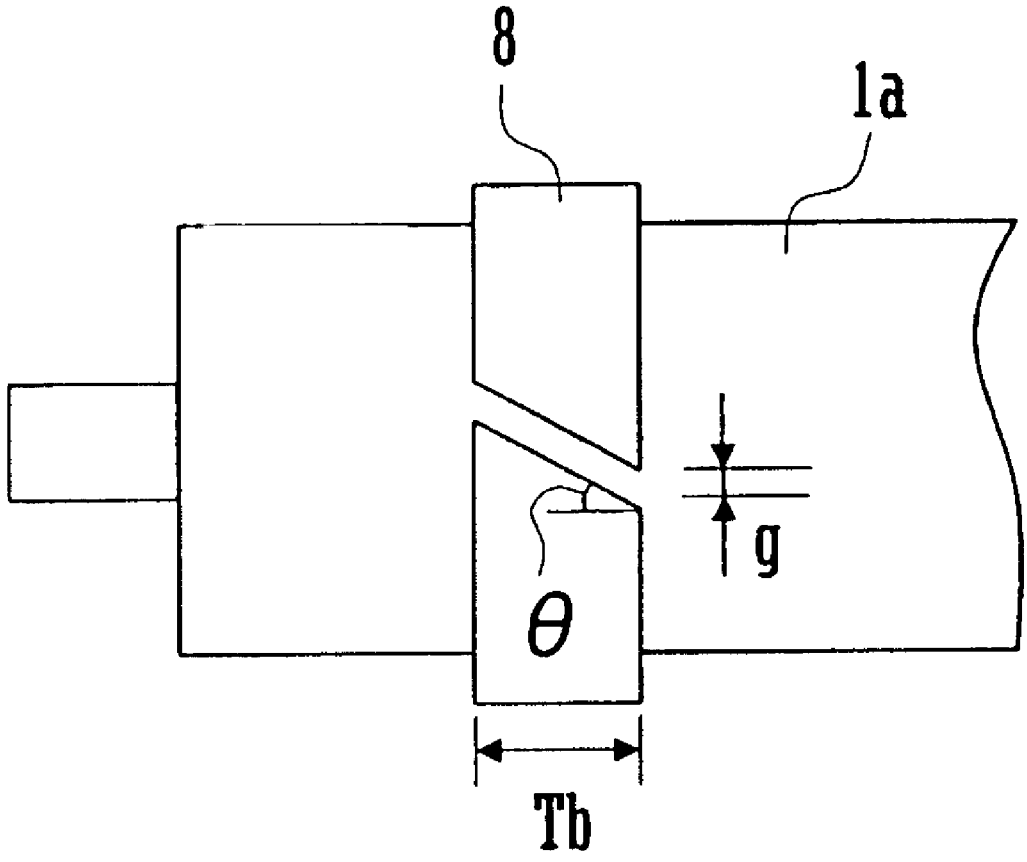
FIG. 5 is a diagram illustrating a manner in which a spacer is wound around the noncontact charging roller.

As shown in FIG. 5, for example, the spacers 8 are wound with a single turn around the roller 1*a*. Opposite ends of the spacers 8 are cut at an angle and arranged to face each other. Each of the spacers 8 consists of a tape of resin material. In the configuration, the following inequality is preferably satisfied at ordinary temperatures of 20 through 25° C.:

$$Tb*\cos\theta > \pi*(Rc+Tp)-Lt \geqq 0.1 \quad (1),$$

where Lt (mm) is natural length of the tape, Tp (mm) is thickness of the tape, Rc (mm) is outside diameter of the charging roller 1*a*, Tb (mm) is width of the tape, and θ is an angle at which the opposite ends of the tape are cut.

The tape of resin material has a linear expansion coefficient of approximately $10*10^{-5}$. The charging roller 1*a* has an outside diameter of approximately 11 mm. If a metal shaft of the roller 1*a* has a linear expansion coefficient of $1.1*10^{-5}$, there is a difference in thermal expansion of approximately 100 μm between circumferential lengths of the tape and the roller 1*a* at a temperature rise of 30° C.

Accordingly, a difference in circumferential length, i.e., a gap g, of 100 μm or longer at ordinary temperatures is provided, so that the circumferential length of the tape do not become longer than that of the roller 1*a* at the temperature rise. Thus, even though the tape is subject to repeated friction, the tape is prevented from becoming unwound, and thus from coming detached or from having the opposite ends overlapped. Also, the difference in circumferential length is set to be smaller than Tb*cos θ, so that the spacers 8 are seamlessly wound around the charging roller 1*a*. Thus, the gap 3 is precisely adjusted.

Figure 6:
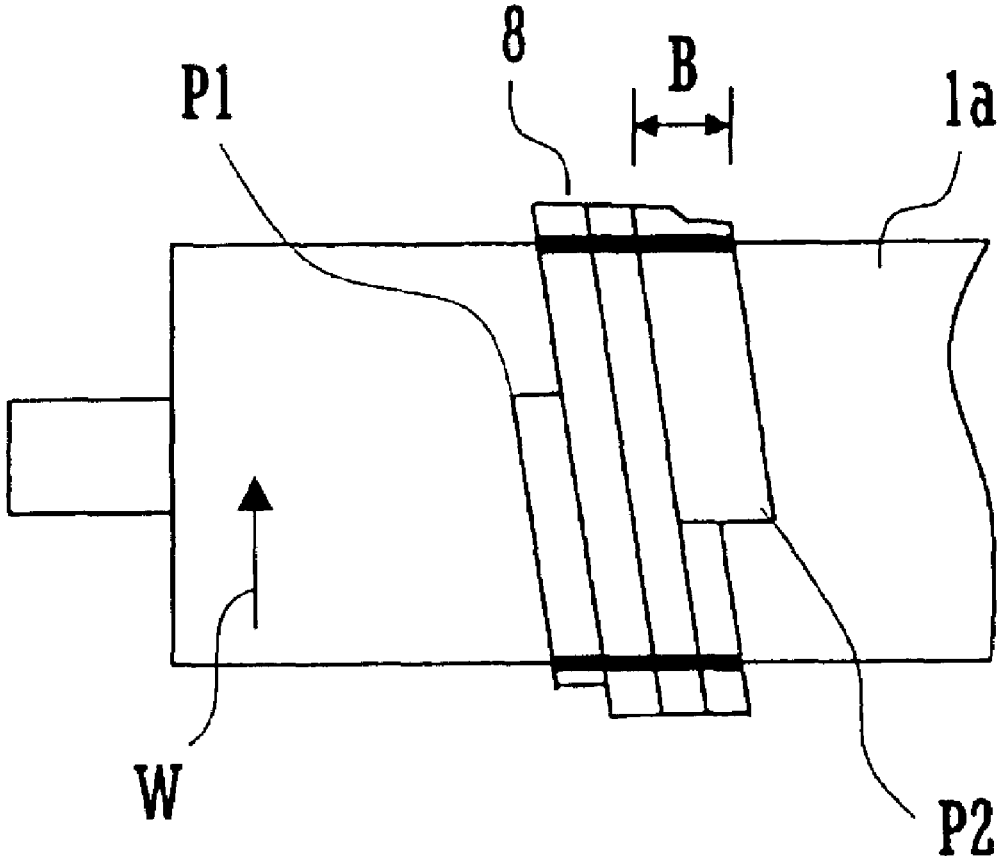
FIG. 6 is a diagram illustrating another manner in which the spacer is wound around the noncontact charging roller.

FIG. 6 illustrates another embodiment in which the spacers 8 are wound with a plurality of turns around the charging roller 1*a* that is being rotated in a direction of arrow W. The spacers 8 are wound seamlessly, with an edge of a turn overlapped with a subsequent turn. As shown in FIG. 6, the spacers 8 of width B are wound, beginning at an end portion P1 and ending at an end portion P2.

A seam between the turns would cause a problem of carrier and toner particles being accumulated on an adhesive sticking out through the seam or in a groove formed in the seam. The accumulated carrier and toner particles would gradually develop enough to prevent the gap 3 from being precisely adjusted.

To solve the problem, the spacers 8 are wound spirally with an edge of a turn overlapped with a subsequent turn, as described above. Since an edge of a first turn is overlapped with a second turn, the edge is prevented from coming detached because of a potential difference in circumferential speed between the roller 1*a* and the photoreceptor drum 2.

Figure 7:
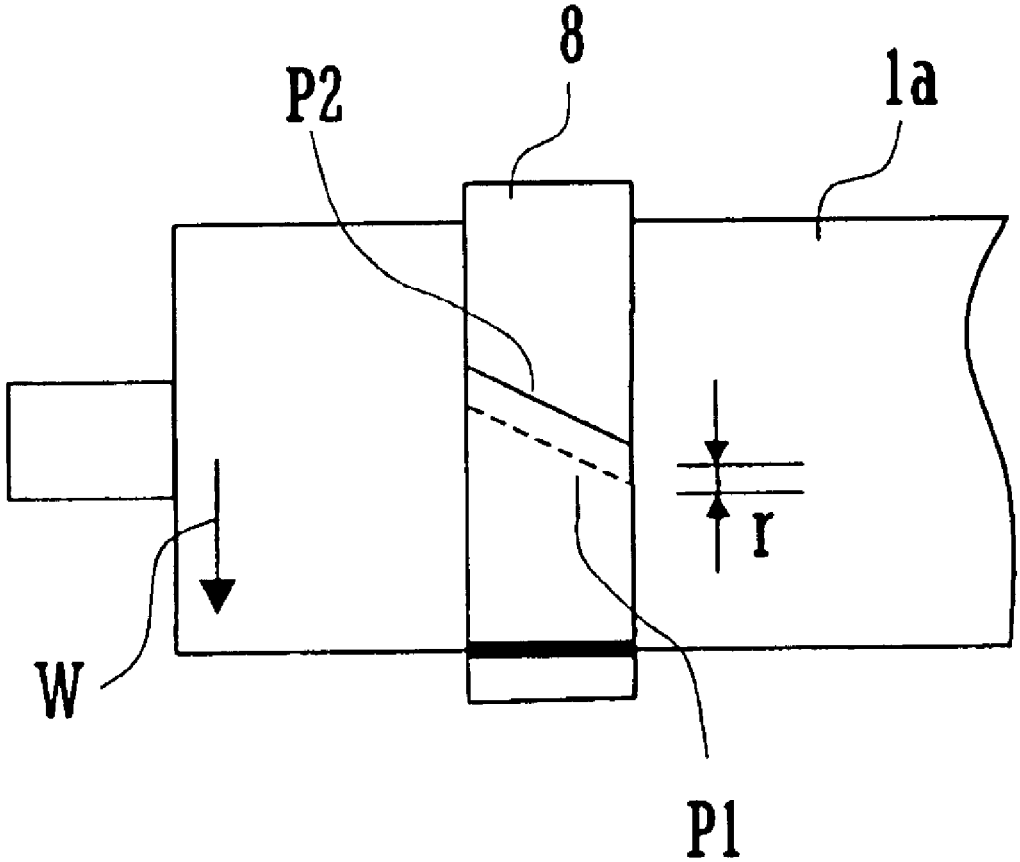
FIG. 7 is a diagram illustrating another manner in which the spacer is wound around the noncontact charging roller.

FIG. 7 illustrates still another embodiment in which the spacers 8 are wound with a single turn around the charging roller 1*a* that is being rotated in a direction of arrow W. The end portion P1 is covered with the end portion P2 so that a diagonal overlap r is formed.

The diagonal overlap r allows the end portion P1 to be covered with the end portion P2 as exposed, thereby preventing the portion P1 from coming detached. Also, the diagonal overlap r allows a reduced fluctuation in the gap 3.

Figure 8:
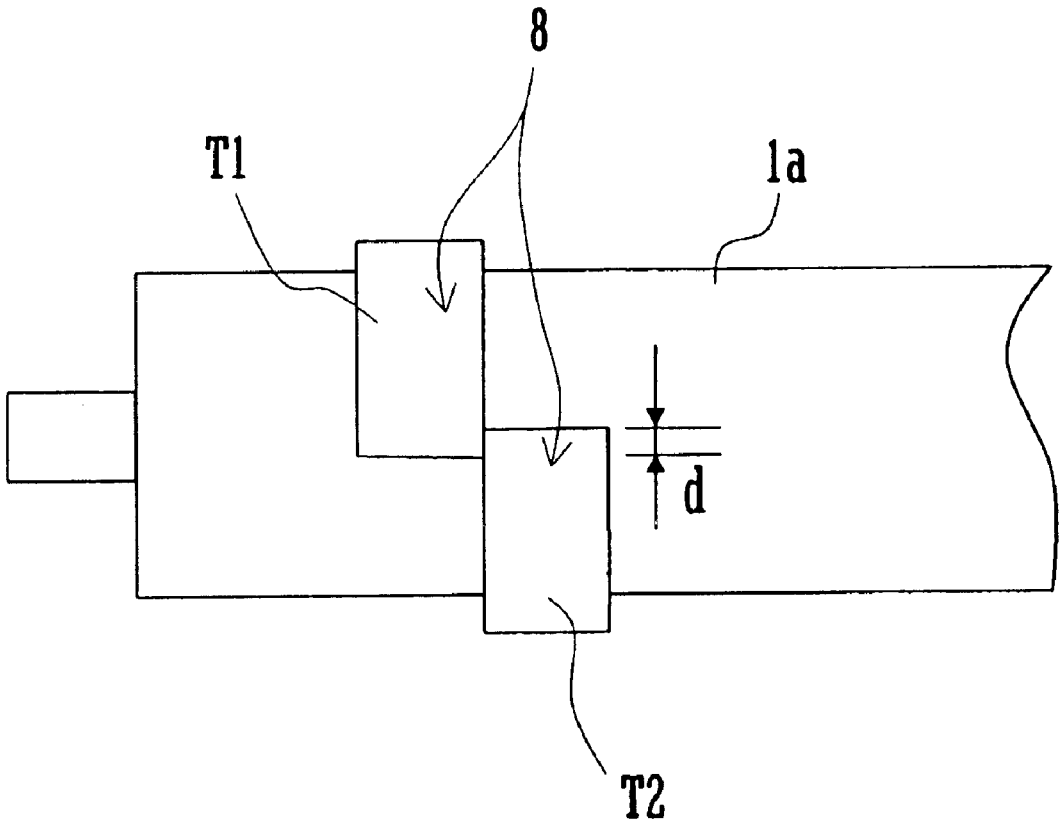
FIG. 8 is a diagram illustrating another manner in which the spacer is wound around the noncontact charging roller.

FIG. 8 illustrates yet another embodiment in which the spacers 8 each consist of two parts T1 and T2. Each of the two parts T1 and T2 is shorter than the circumference of the charging roller 1*a*. A vertical, circumferential cross-section of the charging roller 1*a* is a circle, and the parts T1 and T2 each have length corresponding to length of an arc of the circle with a central angle of 200 degrees. The parts T1 and T2 are wound adjacently around the charging roller 1*a*, so as to be shifted with respect to each other in an axial direction of the roller 1*a*. Also, the parts T1 and T2 have respective end portions of width d aligned in the axial direction.

Since the parts T1 and T2 are shifted with respect to each other in the axial direction, the respective end portions of the parts T1 and T2 are prevented from facing each other in a circumferential direction of the roller 1*a*. Thus, there is no seam between the parts T1 and T2. Accordingly, accumulation of carrier and toner particles is avoided, so that the gap 3 is precisely adjusted.

Figure 9:
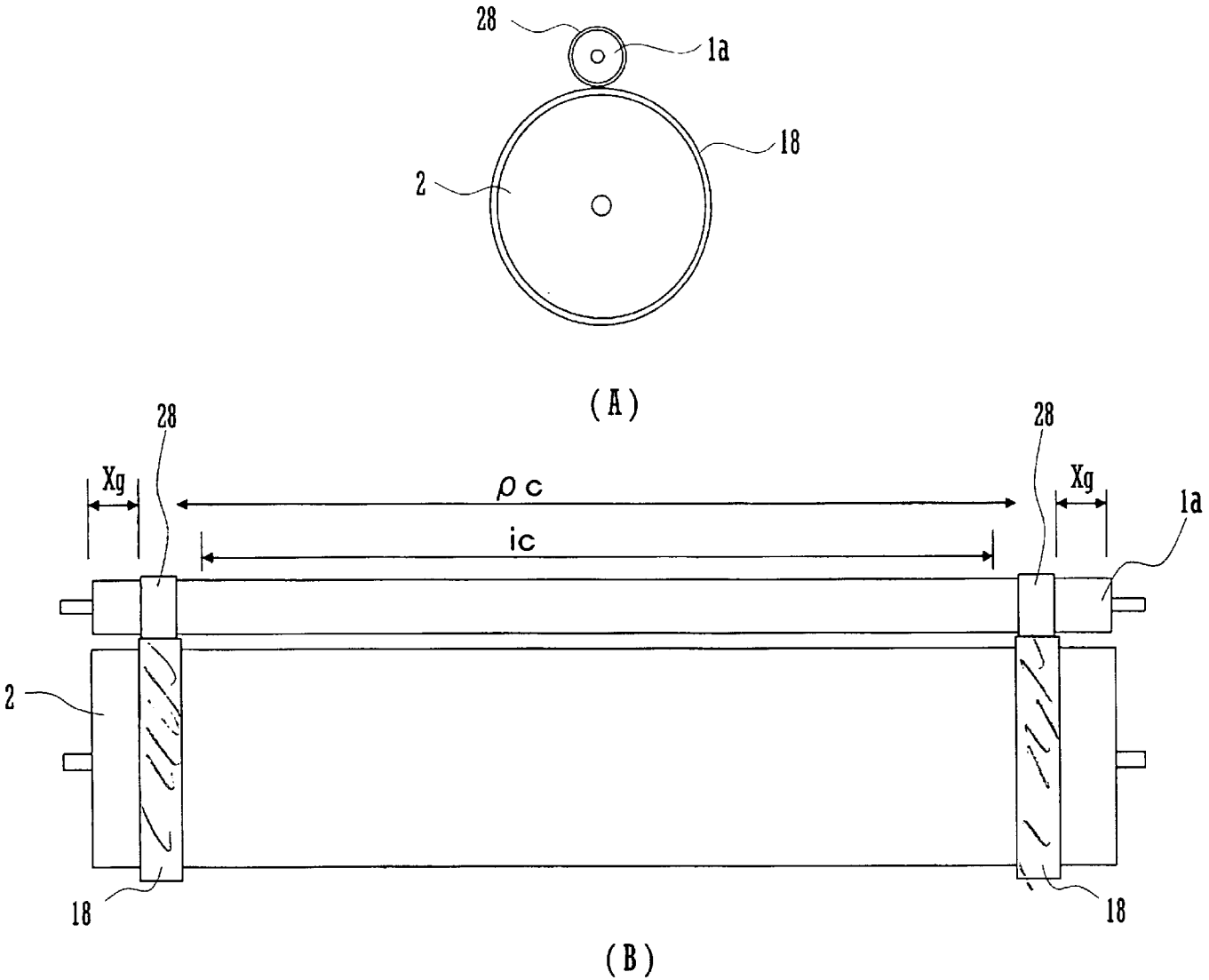
FIGS. 9(A) and 9(B) are diagrams illustrating spacers as wound around both the photoreceptor drum and the noncontact charging roller.

FIGS. 9(A) and 9(B) illustrates yet another embodiment of the invention. In the embodiment, first spacers 18 are wound around the photoreceptor drum 2 so as to be pressed against second spacers 28 that are wound around the charging roller 1*a*.

The second spacers 28 have higher abrasion resistance and higher durability than the spacers 8 in the first embodiment. Also, the first spacers 18 each have a circumferential length larger than that of each of the spacers 8. Accordingly, the first spacers 18 and the second spacers 28 are less subject to abrasion, thereby allowing a reduced fluctuation in the gap 3. Since the spacers 18 are to be replaced simultaneously together with the photoreceptor drum 2, the charging system has an increased life and improved reliability. Alternatively, only the spacers 18 may be provided for being wound around the photoreceptor drum 2, with no spacers wound around the roller 1*a*.

Now described below are results obtained from simulations on deformation of the photoreceptor drum 2 with the flanges 9 pressed thereinto. The obtained results have been proved to correspond well to actual measurement values. From the results, a preferable relationship is obtained among wall thickness t (mm) of the base shaft of the photoreceptor drum 2, distance Xg (mm) from the opposite ends of the photoreceptor drum 2 to the respective winding positions of the spacers 18, and diameter D (mm) of the photoreceptor drum 2.

Used in the simulations were nine (9) base shafts having suitable sizes for the photoreceptor drum 2. The shafts have outside diameters of 30 mm, 40 mm, and 50 mm, each with wall thicknesses t of 0.8 mm, 1.0 mm, and 1.5 mm. The flanges 9 to be pressed into the ends of each shaft had an effective projection length of 8 mm. Fit tolerance between the shafts and the flanges 9 were set to +20 μm, +40 μm, and +60 μm, respectively for the shafts of the diameter of 30 mm, 40 mm, and 50 mm. Under the forgoing conditions, deformations (Y (μm)) of the respective shafts were analyzed.

Figure 10:
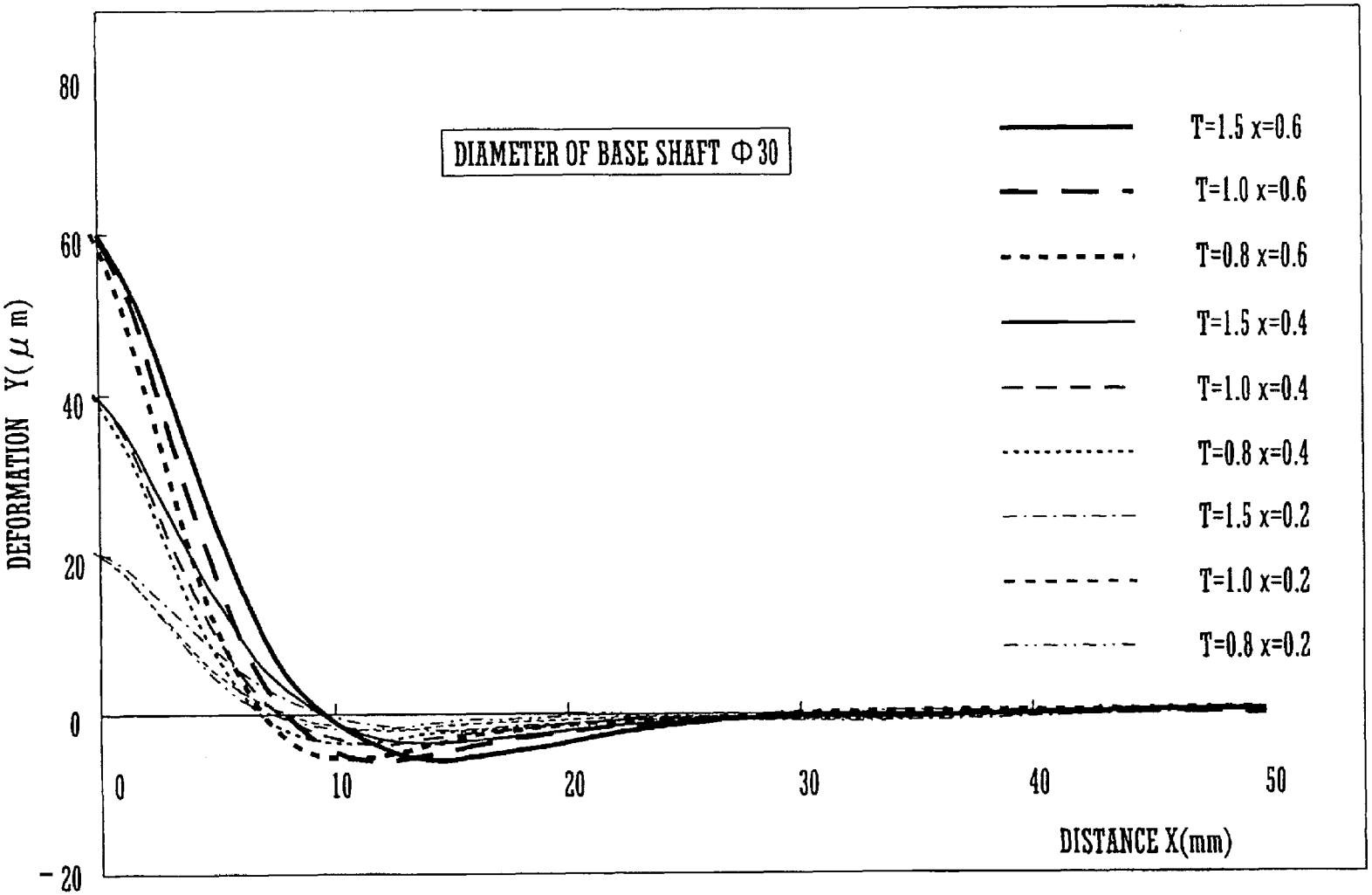
FIG. 10 is a graph showing results obtained from simulations on deformation of a base shaft of the photoreceptor drum having a diameter of 30 mm, with the flanges pressed thereinto.
Figure 11:
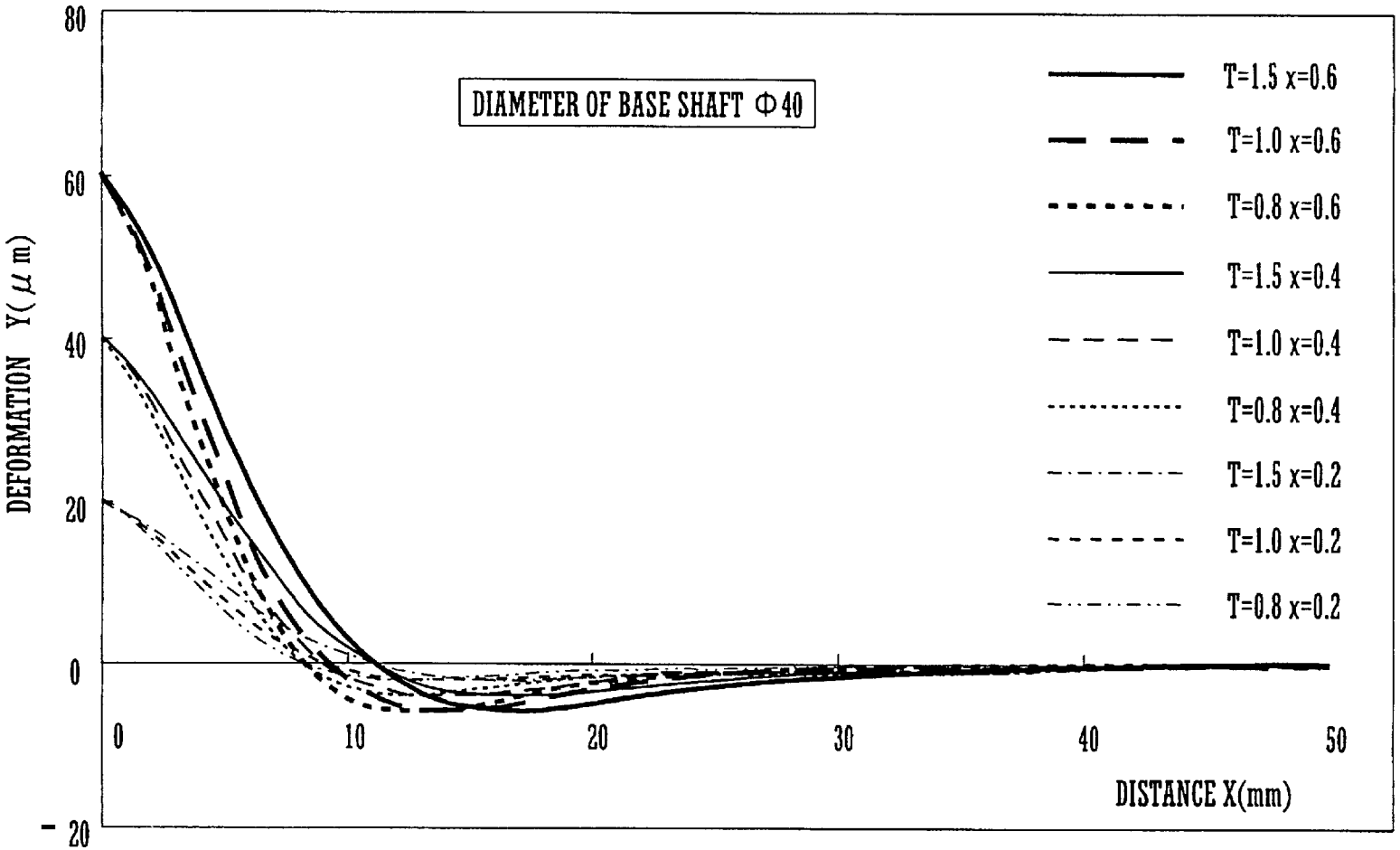
FIG. 11 is a graph showing results obtained from simulations on deformation of a base shaft of the photoreceptor drum having a diameter of 40 mm.
Figure 12:
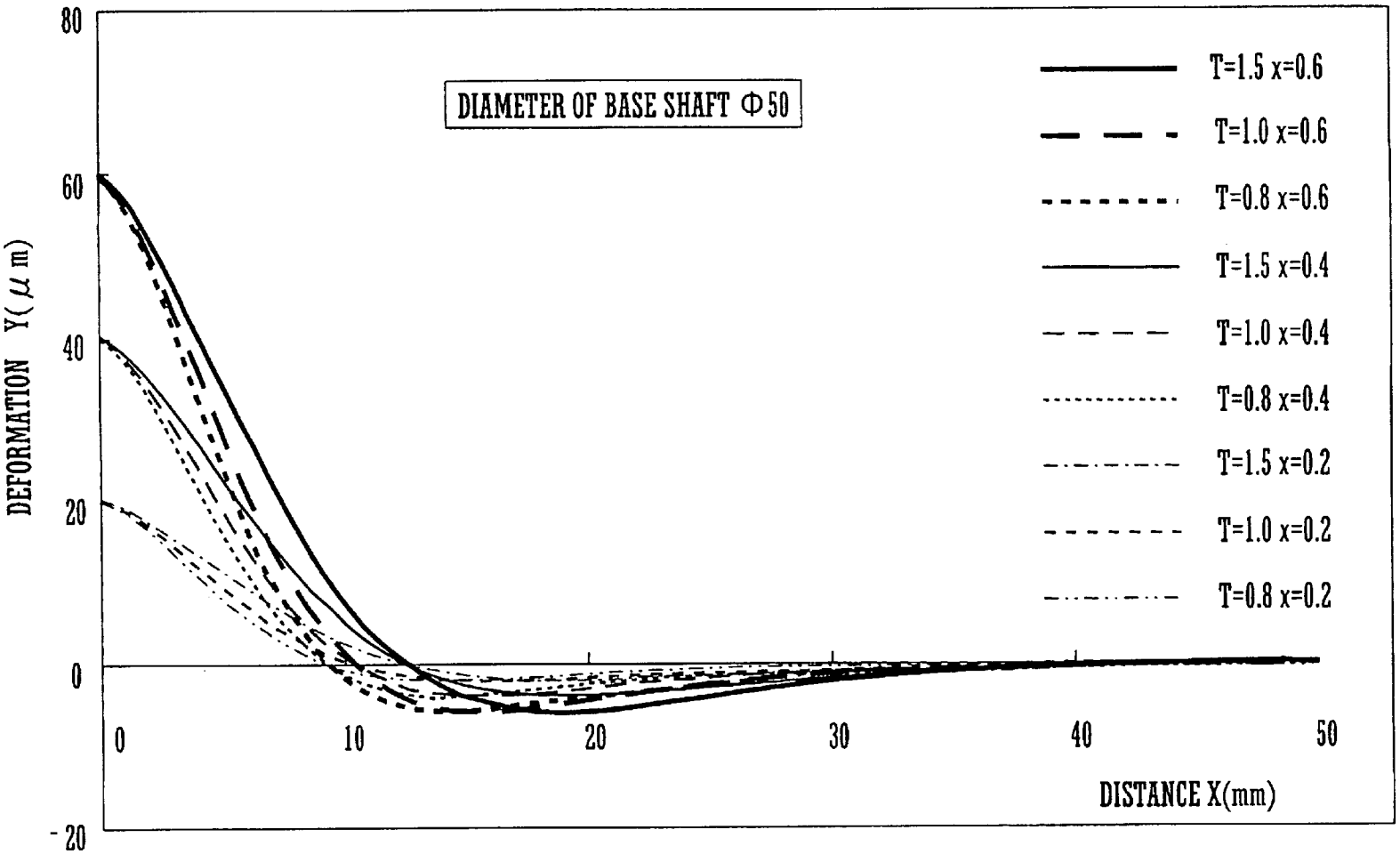
FIG. 12 is a graph showing results obtained from simulations on deformation of a base shaft of the photoreceptor drum having a diameter of 50 mm.
Figure 13:
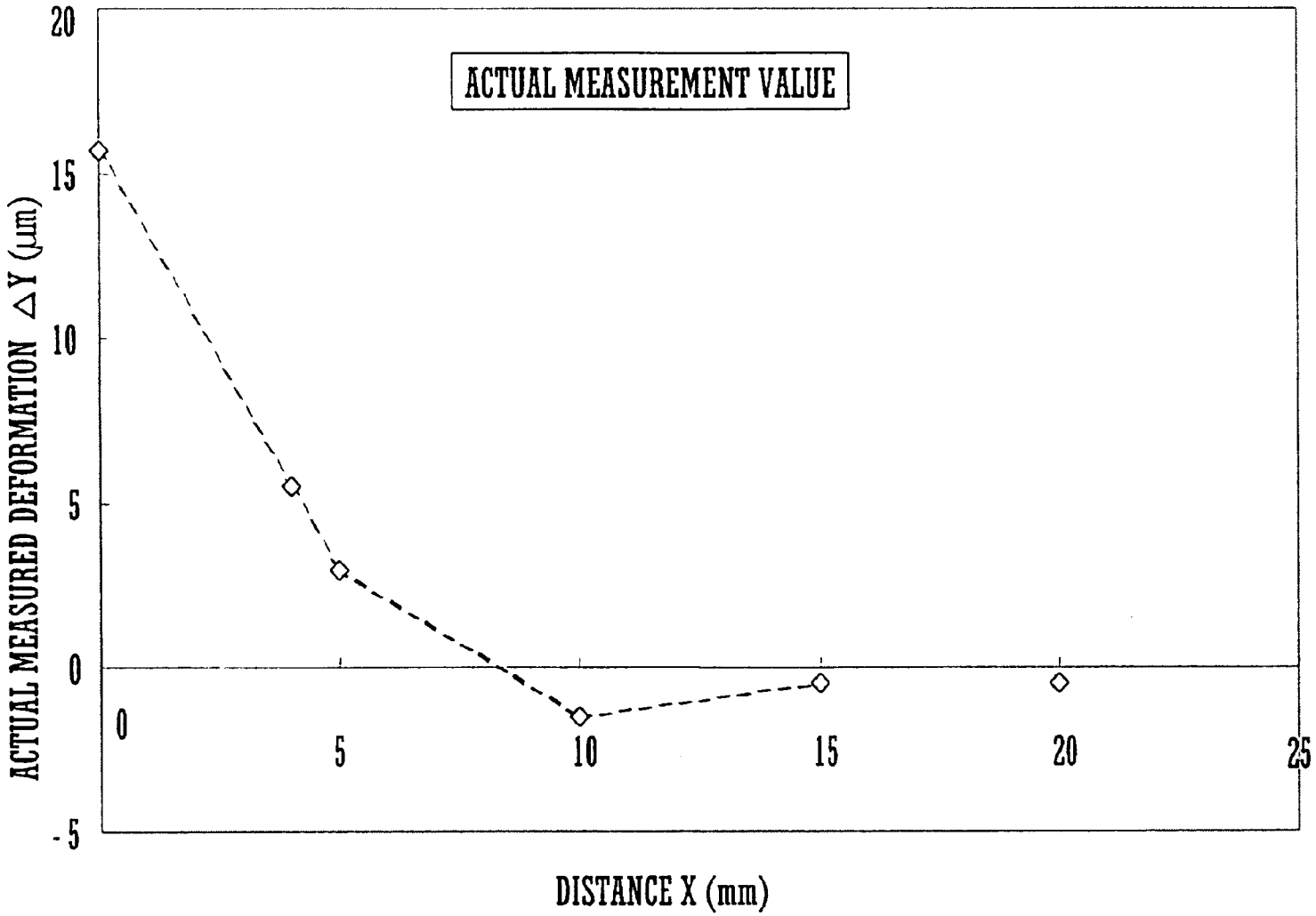
FIG. 13 is a graph showing actual measured deformations of the base shaft having the diameter of 30 mm with the flanges pressed thereinto.

The analysis results for the shafts of the diameters of 30 mm, 40 mm, and 50 mm are as plotted in FIGS. 10 through 12, respectively. FIG. 13 illustrates a graph showing actual measured deformations (ΔY (μm)) of the pressed-in portion of an actual base shaft having a diameter of 30 mm and a wall thickness t of 0.8 mm.

Figure 14:
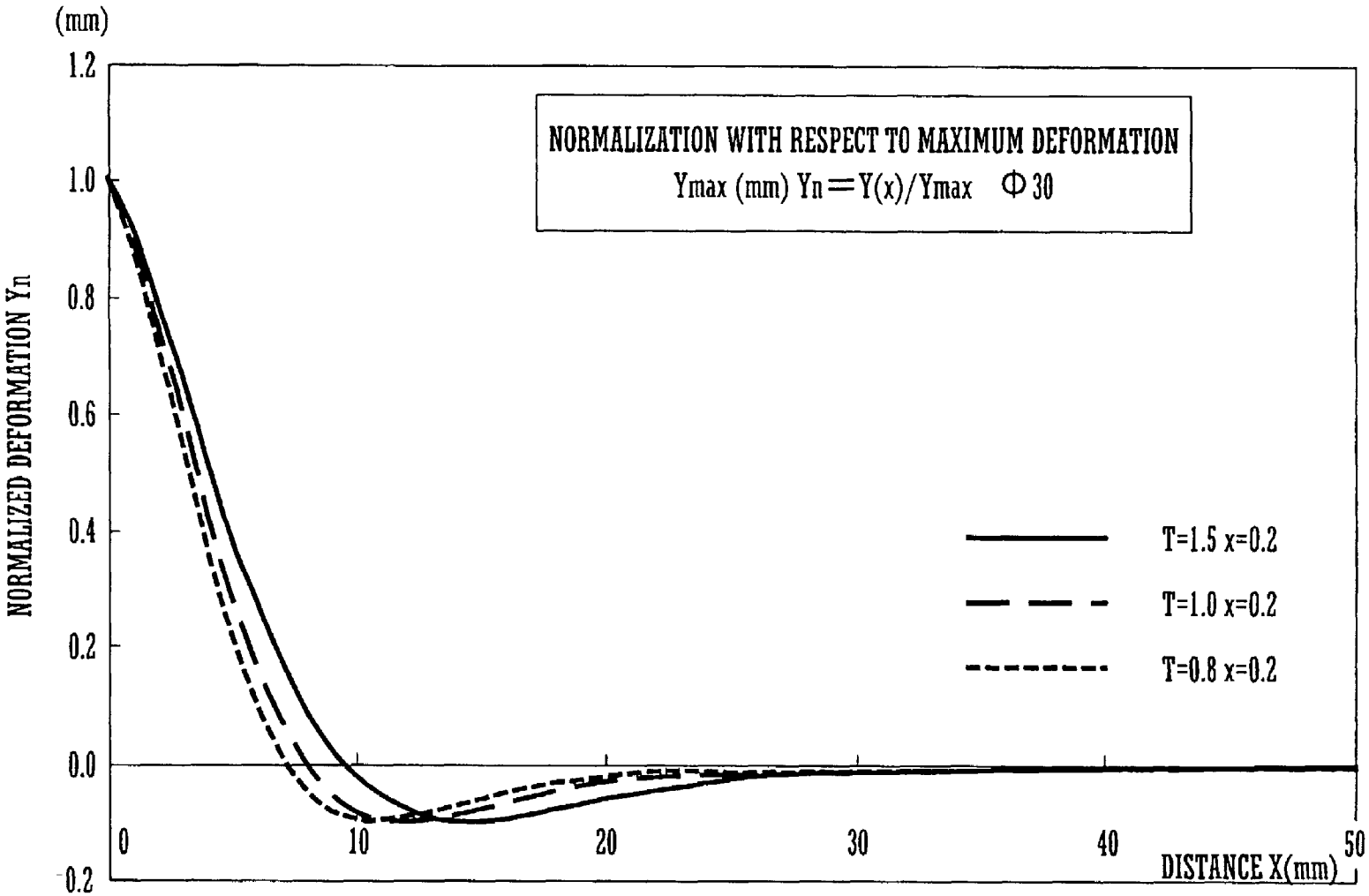
FIG. 14 is a graph showing normalized values obtained by normalizing simulated deformations of the base shaft of the diameter of 30 mm with the flanges pressed thereinto, with respect to a maximum deformation.
Figure 15:
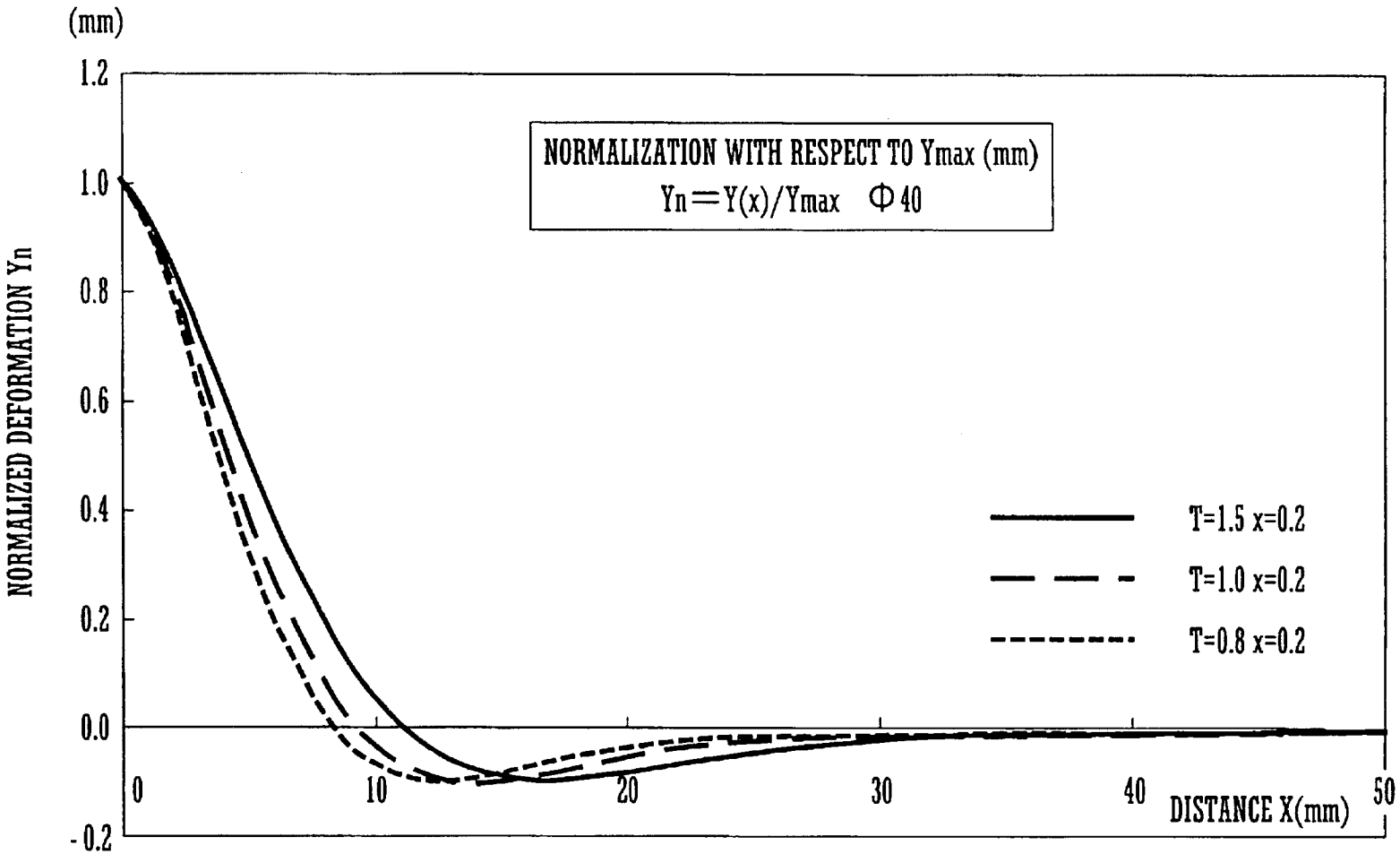
FIG. 15 is a graph showing normalized values obtained by normalizing simulated deformations of the base shaft of the diameter of 40 mm, with respect to a maximum deformation.
Figure 16:
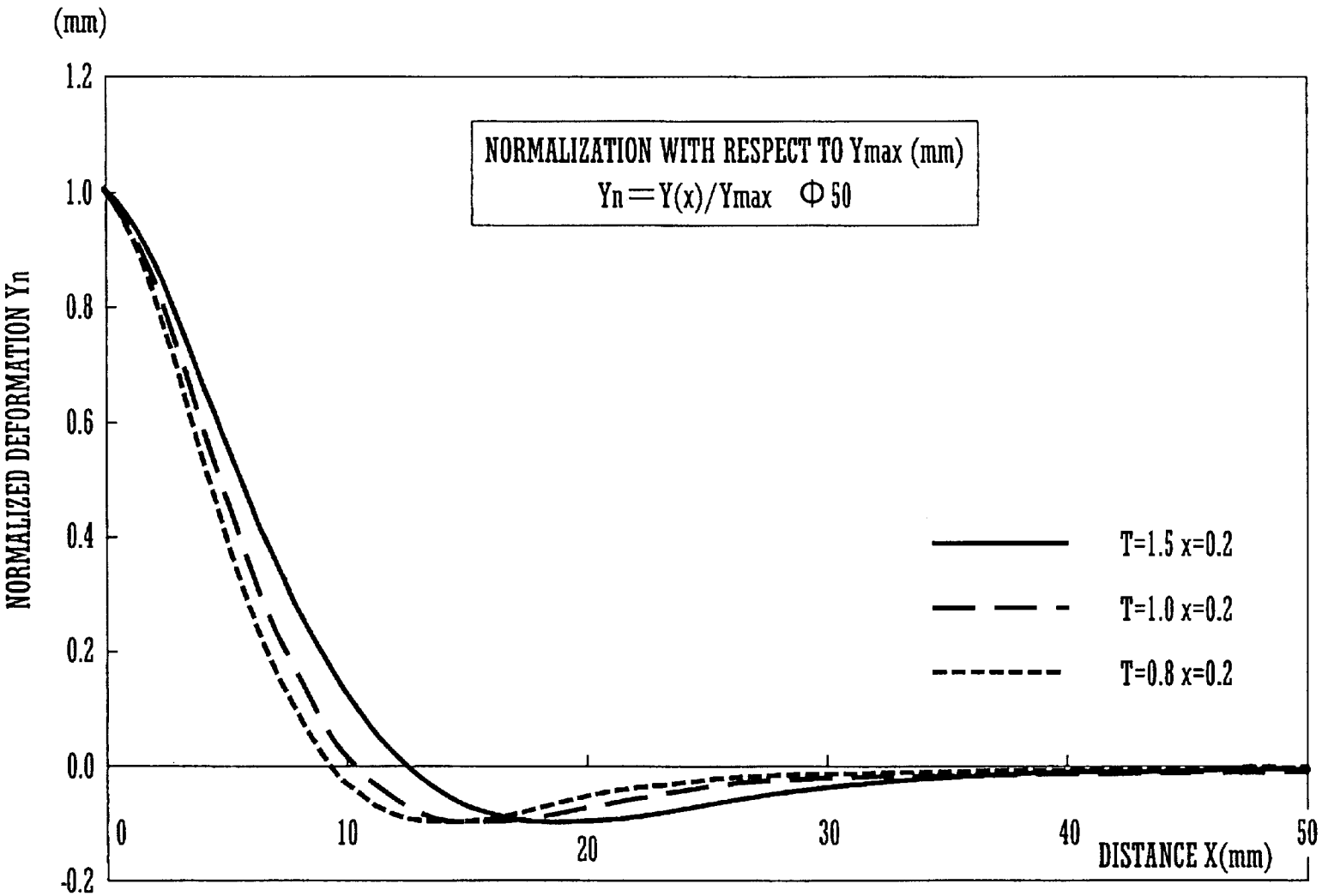
FIG. 16 is a graph showing normalized values obtained by normalizing simulated deformations of the base shaft of the diameter of 50 mm, with respect to a maximum deformation.

Also, FIGS. 14 through 16 illustrate graphs showing respective normalized values Yn=Y/Ymax for the base shafts of the diameters of 30 mm, 40 mm, and 50 mm, obtained by normalizing the measured deformations Y with respect to a maximum deformation Ymax. As is clear from the figures, it was confirmed that there are three types of curves Yn, for the wall thickness t of 0.8 mm, 1.0 mm, and 1.5 mm, respectively.

Figure 17:
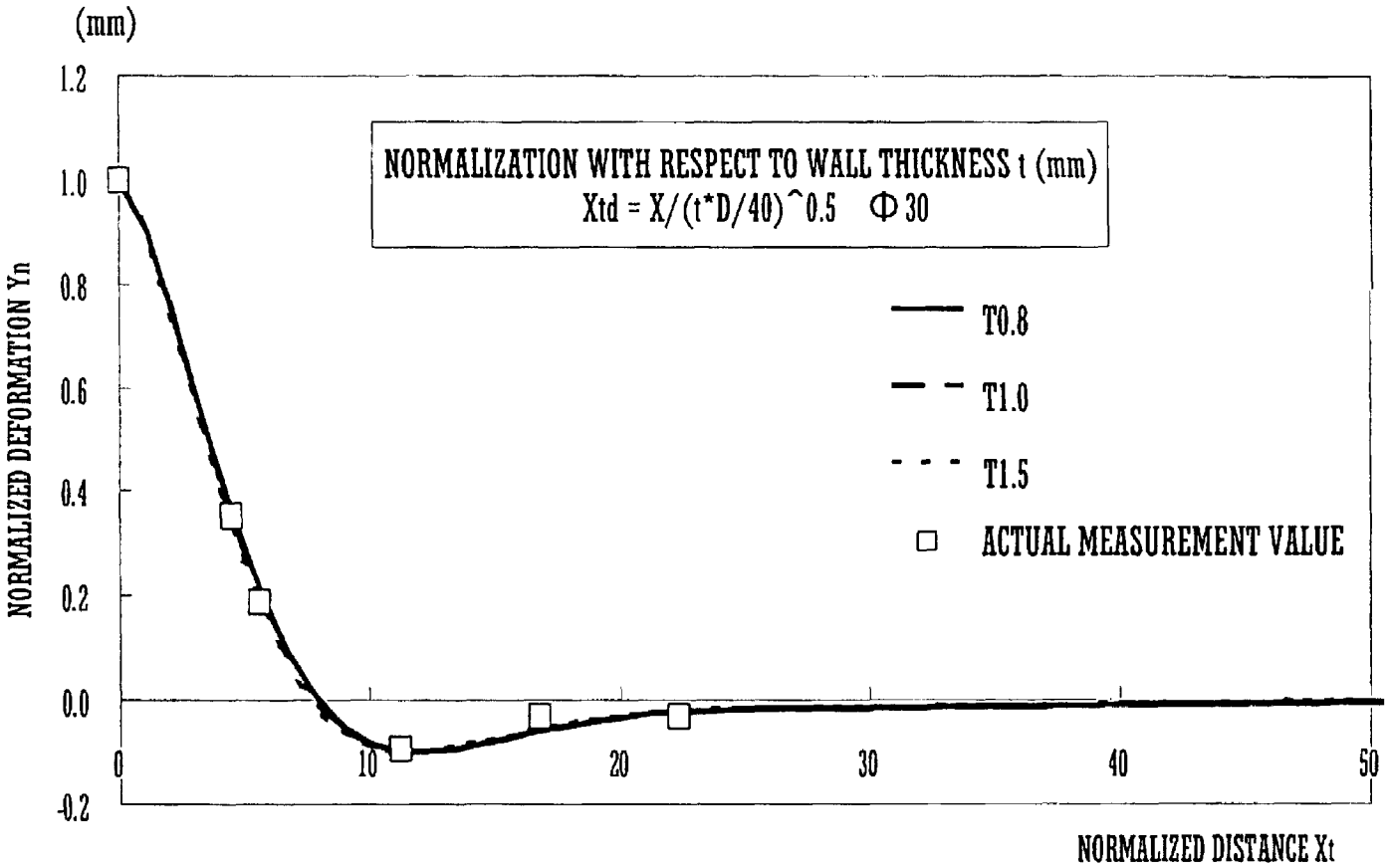
FIG. 17 is a graph showing normalized values obtained by normalizing simulated deformations of the base shaft of the diameter of 30 mm, with respect to a wall thickness of the base shaft.
Figure 18:
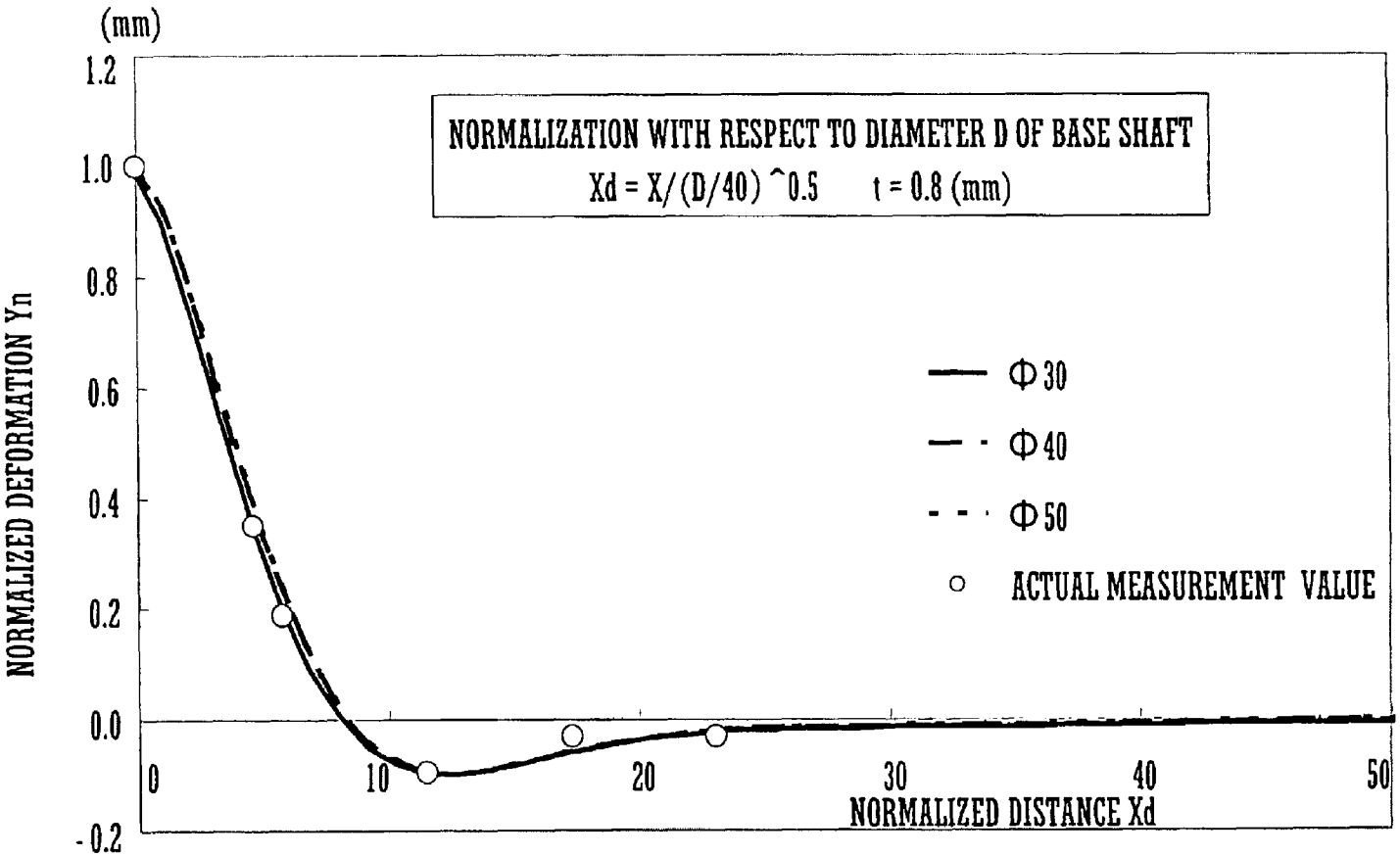
FIG. 18 is a graph showing normalized values obtained by normalizing simulated deformation of a base shaft of a wall thickness t of 0.8 mm with the flanges pressed thereinto, with respect to a diameter D of the base shaft.

FIG. 17 illustrates a graph showing normalized values $Xd=X/(t)^{1/2}$ obtained by normalizing the distance X with respect to the wall thickness t of 1.0 mm. FIG. 18 illustrates a graph showing normalized values $Xd=X/(D/40)^{1/2}$ obtained by normalizing the distance X with respect to the shaft diameter D of 40 mm. As shown in FIGS. 17 and 18, the analysis results as plotted fall on a single curve and correspond well to actual measurement values as depicted by squares in FIG. 17 and by circles in FIG. 18, respectively.

Figure 19:
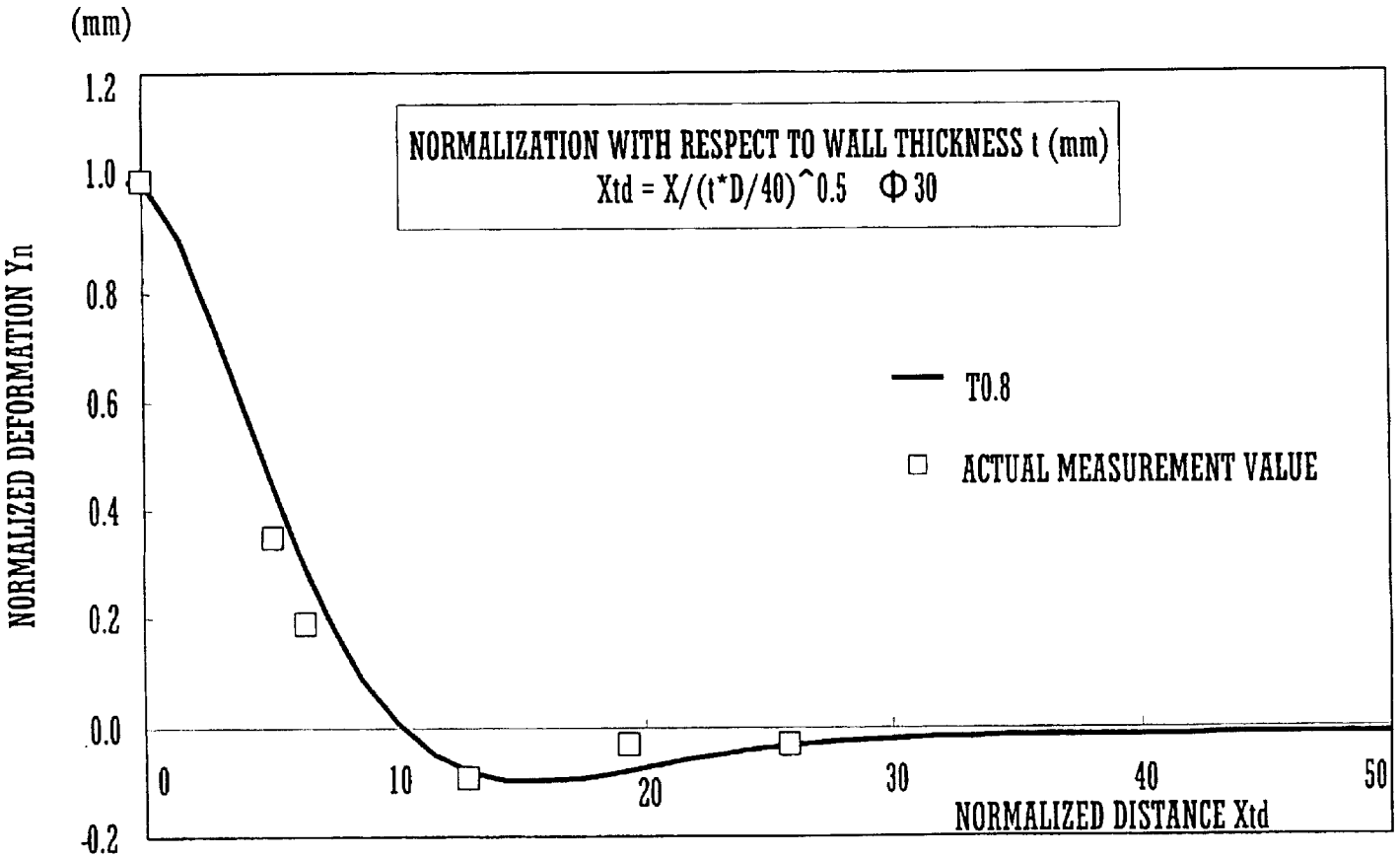
FIG. 19 is a graph showing normalized values obtained by normalizing simulated deformations of the base shaft of the diameter of 30 mm, with respect to a wall thickness of the base shaft.

FIG. 19 illustrates a graph showing normalized values $Xd=X/(t\cdot D/40)^{1/2}$ obtained by normalizing the distance X with respect to the wall thickness t of 1.0 mm and the shaft diameter D of 40 mm. The analysis results also correspond well to the actual measurement values, as depicted by squares in FIG. 19, of an actual base shaft having a wall thickness of 0.8 mm and a diameter of 30 mm. From the foregoing results, conditions can be set as follows.

(1-1) The spacers 18 can be pressed against undeformed positions of the photoreceptor drum 2, irrespective of the wall thickness t of the photoreceptor drum 2, when the following inequality is satisfied:

$$X/t^{1/2}=8 \quad (2),$$

where X (mm) is the distance from the opposite ends of the photoreceptor drum 2 to the respective positions at which the spacers 18 are pressed against the photoreceptor drum 2, and t is the wall thickness (mm) of the photoreceptor drum 2.

(1-2) More preferably, each of the spacers 18 is pressed against the photoreceptor drum 2 in a region between a position corresponding to a peak of undershoot of photoreceptor deformation curve and a middle portion of the photoreceptor drum 2. In the foregoing state, the following inequality is satisfied:

$$X/t^{1/2}=12 \quad (3).$$

(1-3) Most preferably, each of the spacers 18 is pressed against the photoreceptor drum 2 in a region between a middle portion of the photoreceptor drum 2 and a position corresponding to a point converging to 50% or less of the peak of undershoot of photoreceptor deformation curve. In the foregoing state, the following inequality is satisfied:

$$X/t^{1/2}=17.5 \quad (4).$$

(2-1) The spacers 18 can be pressed against undeformed positions of the photoreceptor drum 2, irrespective of the diameter D of the photoreceptor drum 2, when the following inequality is satisfied:

$$X/(D/40)^{1/2}=8 \quad (5),$$

where X (mm) is the distance from the opposite ends of the photoreceptor drum 2 to the respective positions at which the spacers 18 are pressed against the photoreceptor drum 2, and D (mm) is the diameter of the photoreceptor drum 2.

(2-2) More preferably, each of the spacers 18 is pressed against the photoreceptor drum 2 in a region between a position corresponding to a peak of undershoot of photoreceptor deformation curve and a middle portion of the photoreceptor drum 2. In the foregoing state, the following inequality is satisfied:

$$X/(D/40)^{1/2}=12.5 \quad (6).$$

(2-3) Most preferably, each of the spacers 18 is pressed against the photoreceptor drum 2 in a region between a middle portion of the photoreceptor drum 2 and a position corresponding to a point converging to 50% or less of the peak of undershoot of photoreceptor deformation curve. In the foregoing state, the following inequality is satisfied:

$$X/(D/40)^{1/2}=18.5 \quad (7).$$

(3-1) The spacers 18 can be pressed against undeformed positions of the photoreceptor drum 2, irrespective of the wall thickness t and the diameter D of the photoreceptor drum 2, when the following inequality is satisfied:

$$X/(t\cdot D/40)^{1/2}=10 \quad (8),$$

where X (mm) is the distance from the opposite ends of the photoreceptor drum 2 and the respective positions at which the spacers 18 are pressed against the photoreceptor drum 2, t (mm) is the wall thickness of the photoreceptor drum 2, and D (mm) is the diameter of the photoreceptor drum 2.

(3-2) More preferably, each of the spacers 18 is pressed against the photoreceptor drum 2 in a region between a position corresponding to a peak of undershoot of photoreceptor deformation curve and a middle portion of the photoreceptor drum 2. In the foregoing state, the following inequality is satisfied:

$$X/(t\cdot D/40)^{1/2}=16 \quad (9).$$

(3-3) Most preferably, each of the spacers 18 is pressed against the photoreceptor drum 2 in a region between a middle portion of the photoreceptor drum 2 and a position corresponding to a point converging to 50% or less of the peak of undershoot of photoreceptor deformation curve. In the foregoing state, the following inequality is satisfied:

$$X/(t\cdot D/40)^{1/2}=23 \quad (10).$$

According to the present invention, as described above, the winding positions of spacers wound around the noncontact charging roller are distant by more than the effective projection length of each of the flanges from the respective ends of the roller 1*a*. The configuration allows precise adjustment of the gap between the noncontact charging roller and the photoreceptor drum, thereby preventing the photoreceptor drum from being nonuniformly charged because of abnormal discharge or insufficient charging. High-quality image is thus ensured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

a photoreceptor drum that has flanges pressed into opposite ends thereof;

a noncontact charging roller that is arranged so as to face the photoreceptor drum but to have no direct contact with the photoreceptor drum; and spacers for maintaining a gap between the photoreceptor drum and the noncontact charging roller, the spacers being wound around opposite end portions of the noncontact charging roller, wherein winding positions of the spacers are distant by more than an effective projection length of each of the flanges from the respective opposite ends of the charging roller, and wherein the winding positions are distant by twice the effective projection length to approximately 10 mm from the respective opposite ends of the charging roller.

2. An image forming apparatus according to claim 1, wherein the flanges each have an outside diameter smaller than an inside diameter of the photoreceptor drum and are fixedly bonded to the respective opposite ends of the photoreceptor drum with an adhesive that has a linear expansion coefficient approximately equal to a linear expansion coefficient of the photoreceptor drum.

3. An image forming apparatus according to claim 1, wherein the spacers are each wound with a single turn around the noncontact charging roller, with opposite ends of each spacer cut at an angle and arranged so as to face each other across a gap of predetermined width.

4. An image forming apparatus according to claim 1, wherein the spacers are each wound with a plurality of turns around the noncontact charging roller.

5. An image forming apparatus according to claim 1, wherein the spacers each have two parts that are shorter than the circumference of the noncontact charging roller, the two parts being wound adjacently around the charging roller.

6. An image forming apparatus according to claim 1, wherein the following inequality is satisfied:

$$X/(D/40)^{1/2} \geqq 8,$$

where X (mm) is distance from the opposite ends of the photoreceptor drum to respective positions at which the spacers are pressed against the photoreceptor drum, and D (mm) is diameter of the photoreceptor drum.

7. An image forming apparatus according to claim 1, wherein the following inequality is satisfied:

$$X/(t \cdot D/40)^{1/2} \geqq 10,$$

where X (mm) is distance from the opposite ends of the photoreceptor drum to respective positions at which the spacers are pressed against the photoreceptor drum, t (mm) is wall thickness of the photoreceptor drum, and D (mm) is diameter of the photoreceptor drum.

8. An image forming apparatus, comprising:

a photoreceptor drum that has flanges pressed into opposite ends thereof;

a noncontact charging roller that is arranged so as to face the photoreceptor drum but to have no direct contact with the photoreceptor drum; and spacers for maintaining a gap between the photoreceptor drum and the noncontact charging roller, the spacers being wound around opposite end portions of the noncontact charging roller, wherein winding positions of the spacers are distant by more than an effective projection length of each of the flanges from the respective opposite ends of the charging roller; and wherein the spacers are wound with a single turn around the noncontact charging roller, with opposite ends of each spacer cut at an angle and one end overlapped by the other end on the charging roller.

9. An image forming apparatus, comprising:

a photoreceptor drum that has flanges pressed into opposite ends thereof;

a noncontact charging roller that is arranged so as to face the photoreceptor drum but to have no direct contact with the photoreceptor drum; and spacers for maintaining a gap between the photoreceptor drum and the noncontact charging roller, the spacers being wound around opposite end portions of the noncontact charging roller, wherein winding positions of the spacers are distant by more than an effective projection length of each of the flanges from the respective opposite ends of the charging roller, and wherein the following inequality is satisfied:

$$X/t^{1/2} \geqq 8,$$

where X (mm) is distance from the opposite ends of the photoreceptor drum to respective positions at which the spacers are pressed against the photoreceptor drum, and t (mm) is wall thickness of the photoreceptor drum.

* * * * *